US005197366A

United States Patent [19]

Paulson et al.

[11] Patent Number: 5,197,366

[45] Date of Patent: Mar. 30, 1993

[54] ROLLER ASSEMBLY FOR PAPERBOARD SLITTING APPARATUS

[75] Inventors: Richard F. Paulson; Kent L. Ross, both of Phillips, Wis.

[73] Assignee: Marquip, Inc., Phillips, Wis.

[21] Appl. No.: 921,811

[22] Filed: Jul. 29, 1992

[51] Int. Cl.[5] ..... B26D 1/22

[52] U.S. Cl. ..... 83/498; 83/501; 83/506; 83/508.2; 83/675

[58] Field of Search ..... 83/425.4, 495, 497, 83/498, 499, 500, 501, 502, 505, 506, 508.2, 508.3, 675

[56] References Cited

U.S. PATENT DOCUMENTS

| | | | |
|---|---|---|---|
| 3,186,282 | 6/1965 | Waterhouse | 83/500 |
| 3,996,828 | 12/1976 | Granger et al. | 83/500 |
| 4,520,704 | 6/1985 | Olshansky et al. | 83/500 |
| 4,676,133 | 6/1987 | Fujimura | 83/499 |
| 5,090,281 | 2/1992 | Paulson et al. | 83/498 |

*Primary Examiner*—Frank T. Yost
*Assistant Examiner*—Scott A. Smith
*Attorney, Agent, or Firm*—Andrus, Sceales, Starke & Sawall

[57] ABSTRACT

A roller assembly for supporting a running web of corrugated paperboard in a slitting apparatus includes a pair of rollers which define therebetween a slot for receipt of a rotary slitting blade. The rollers are mounted on separate rotational axes which are angled slightly with respect to one another so that the axially inner edge portions of the rollers where the blade enters the slot therebetween actually engage the blade edge and the diametrically opposite edge portions of the rollers are maximally spaced to define between the adjacent roller faces a downwardly divergent slot. Roller contact with the blade faces helps prevent paperboard adhesive build up and the entry of scrap into the slot. The downwardly divergent shape of the slot allows scrap which does enter therein to be discharged readily with rotation of the rollers. The roller assembly is adapted to be carried with the slitting blade and automatically positioned with the mechanism used to drive and lock the slitting blade in operating position. Each roller assembly is rotatably mounted on its supporting bracket for movement between a maximum blade overlap utilized during repositioning and complete disengagement from the blade as for blade replacement. Spring biased rotational mounting of the roller assembly allows it to be rotated to optimal slitting position under the weight of the moving paperboard web.

9 Claims, 2 Drawing Sheets

FIG. 1
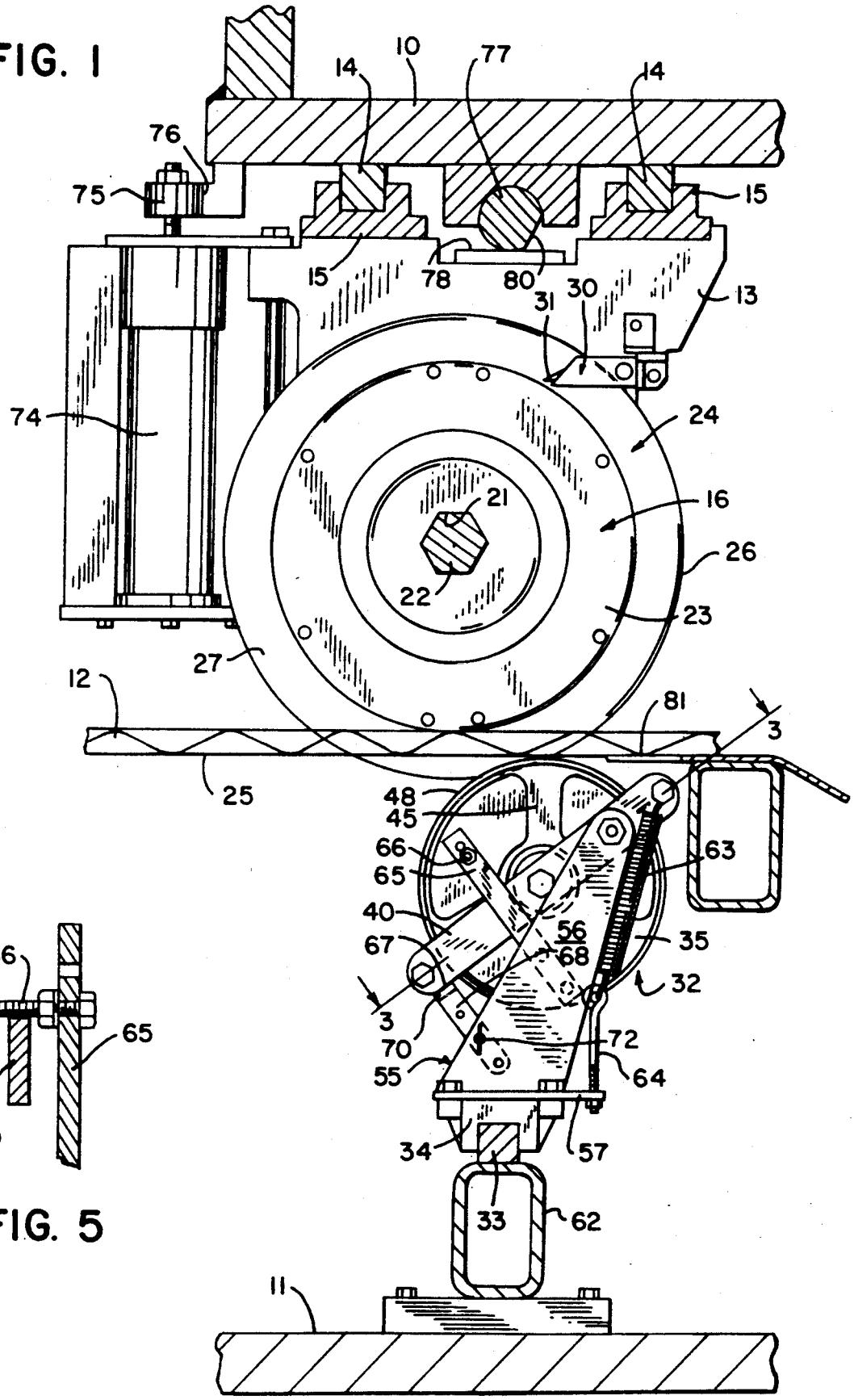
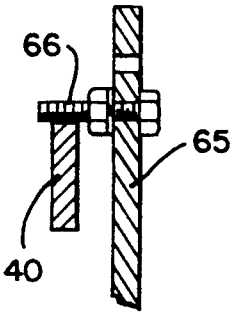
FIG. 5

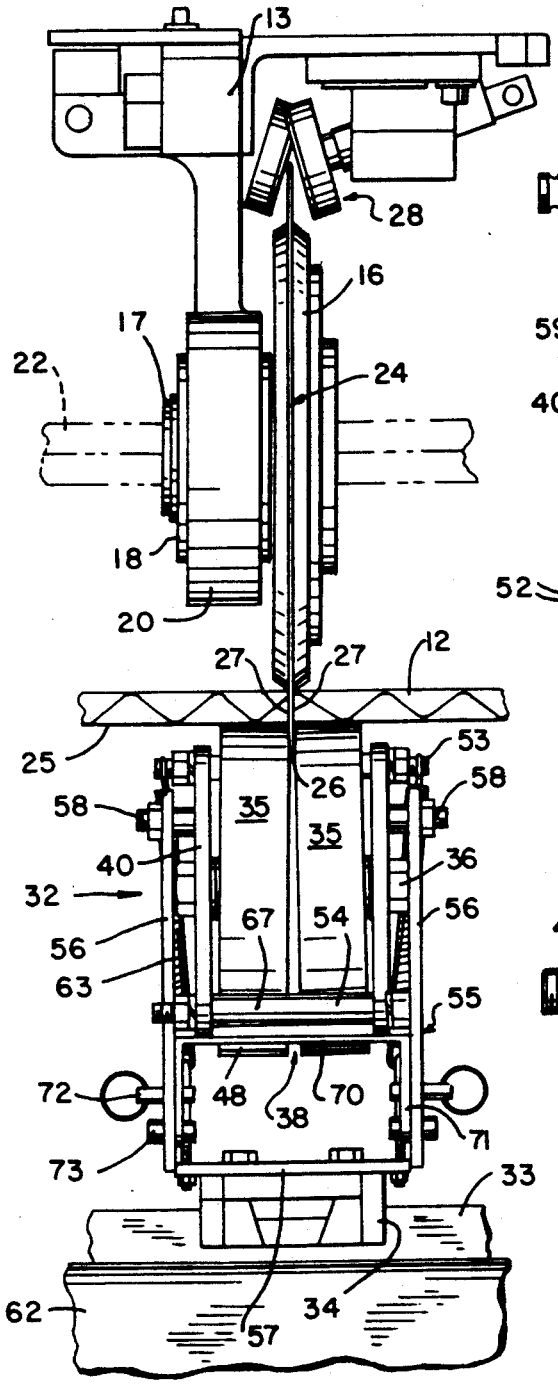
FIG. 2
FIG. 3
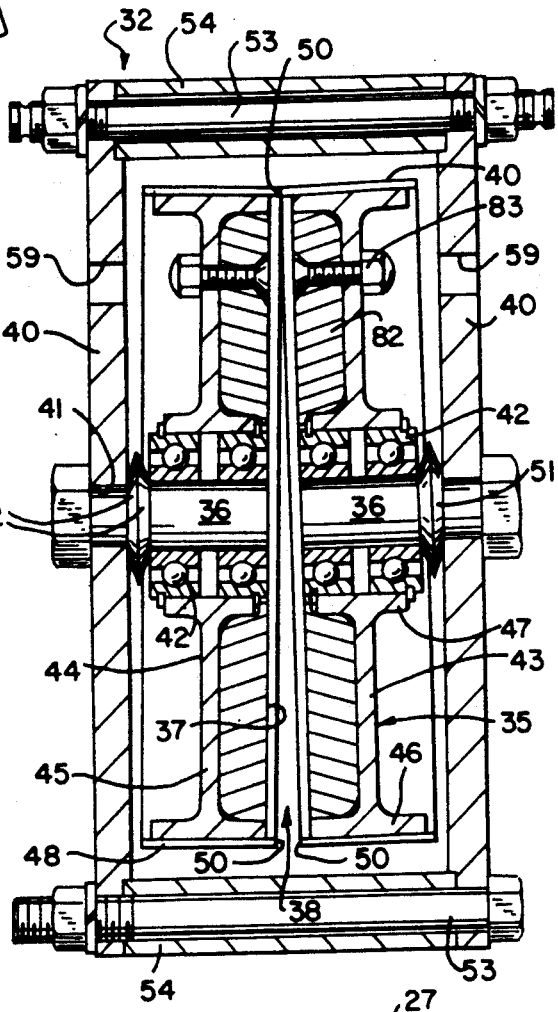
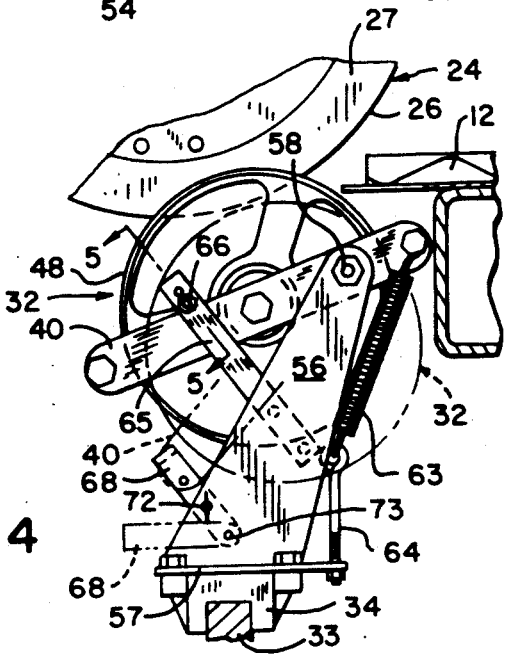
FIG. 4

ROLLER ASSEMBLY FOR PAPERBOARD SLITTING APPARATUS

BACKGROUND OF THE INVENTION

The present invention relates to an apparatus for slitting a traveling web of corrugated paperboard or the like and, in particular, to an idler roller assembly for supporting the running web below and in cooperation with an upper rotary slitting blade.

Apparatus for longitudinally slitting a continuous running web of corrugated paperboard is well known in the art. Such apparatus often includes a related mechanism for simultaneously providing longitudinal score lines in the advancing web, which score lines facilitate subsequent folding in the construction of boxes or the like. Thus, a combined slitter-scorer utilizes pairs of rotatable cutting tools and scoring tools disposed in the path of the advancing web of corrugated paperboard, with one tool of each pair disposed on an opposite side of the web. Typically, multiple slitting tools are mounted coaxially and laterally spaced across the width of the web and, likewise, multiple scoring tools are also coaxially mounted and spaced across the width of the web.

A conventional prior art device is shown for example in U.S. Pat. No. 4,627,214.

Each pair of upper and lower slitting tools is disposed with overlapping radial cutting edges between which the advancing paperboard web is moved to provide a continuous slit. Although commonly referred to as a "slitting" operation, the cutting tools of this type of prior art device in fact shear the moving sheet, resulting in a relative vertical displacement of the adjacent cut edges. However, problems arise as the thickness of the web increases, resulting in cuts which tend to become more ragged, edges which tend to be crushed, and a general degradation in the slit quality. Prior art methods also generate significant amounts of dust, resulting in a wide variety of well known environmental, operational, maintenance and quality control problems.

U.S. Pat. No. 5,090,281 discloses a slitting apparatus which represents a significant improvement in the above described prior art shear-type slitting apparatus. In this apparatus, the paperboard web is cut with a true slitting technique utilizing an apparatus in which the advancing web is directed through a thin circular blade rotating at high speed and running in the same direction as the web, with the board supported below the blade by rollers in contact with the underside of the web. This apparatus reduces significantly the generation of paperboard dust in the slitting operation and improves slit quality. However, particularly when used to slit a paperboard web at the dry end of a corrugating operation, there is a tendency for the adhesive used to bind the multilayer corrugated paperboard web to adhere to the cutting edge and side faces of the slitting blade. Typical paperboard adhesives are starch-based and the build up of adhesive on the blade carries with it some paperboard dust which is inevitably generated even in the improved slitting apparatus. The improved system described in the above identified patent also utilizes blade lubrication to prevent adhesive build up on the cutting blade. It has been found, however, that a corresponding build up of adhesive and paperboard dust occurs on the supporting rollers and, furthermore, the adhesive, dust particles, and the small pieces of board scrap generated during slitting tend to clog the slot in the supporting rollers in which the slitting blade is received.

SUMMARY OF THE INVENTION

The subject invention is directed to improvements in the supporting roller assembly for a slitting apparatus of the type described in U.S. Pat. No. 5,090,281. The improvements minimize the build up of adhesive on the supporting rollers and the entry of adhesive, board dust and board scraps into the blade-receiving slot in the supporting rollers. The assembly also facilitates the discharge of board scrap which does enter the slot.

The improved roller assembly of the present invention includes a pair of rollers which are rotatably mounted to provide tangent contact with the underside of the web and to define therebetween the slot which is positioned to receive the lower edge of the high speed rotary cutting blade positioned over the web, in a manner generally known in the prior art. In accordance with the present invention, the rollers are mounted on separate rotational axes to present adjacent roller faces which define therebetween a blade-receiving slot which is downwardly divergent. Means are also included for biasing the rollers toward one another to cause the axially adjacent radial edge portions of the rollers at the point of web contact to bear against the faces of the blade received in the slot. The axes of the rollers are preferably disposed in a common substantially vertical plane and intersect one another at an angle which is equal to the angle of divergence of the slot.

The roller assembly also preferably includes a pair of side plates for supporting the rollers, each of which plates is positioned adjacent an opposite outer face of one of the rollers. A stub shaft is provided for each roller to define the rotational axis thereof and is attached to one of the side plates to support the roller for rotation thereon. Biasing means are also provided between the side plates and the rollers to bias the rollers toward one another and into contact with the cutting blade. The biasing means may comprise a spring washer or Belleville washer assembly mounted on each stub shaft between the side plate and the adjacent roller face.

The roller assembly also includes means for mounting the assembly relative to the cutting blade to vary the amount of blade edge which is received in the slot. The mounting means includes means for biasing the roller assembly to a position of maximum blade edge receipt in the slot, and further includes upper stop means for limiting the amount of maximum blade edge received in the slot. The roller assembly may also include an adjustable lower stop means which is positioned in the path of movement of the roller assembly in opposition to the biasing means. The lower stop means includes a first position defining a normal slitting position and for preventing disengagement of the blade edge from the slot, and a second position for permitting said disengagement.

The roller assembly of the present invention is adaptable for direct use in prior art slitting apparatus of the type including an upper tool head for mounting the rotary cutting blade, which tool head is movable laterally across the width of the web on a line parallel thereto. The apparatus also includes a lower tool head on which the roller assembly is mounted and which is movable laterally across the width of the web on a line parallel to the line of movement of the upper tool head. Means is also provided for driving one of said upper and lower tool heads across the web and preferably, to drive the upper tool head and to carry the lower tool head therewith.

BRIEF DESCRIPTION OF THE DRAWINGS

FIG. 1 is a side elevation, partly in section, showing the roller assembly of the present invention as part of a paperboard slitting apparatus.

FIG. 2 is an end elevation of the apparatus shown in FIG. 1.

FIG. 3 is an enlarged sectional view of the roller assembly of the present invention taken on line 3—3 of FIG. 1.

FIG. 4 is a side elevation of the roller assembly shown in FIG. 2.

FIG. 5 is a partial sectional view taken on line 5—5 of FIG. 4.

DETAILED DESCRIPTION OF THE PREFERRED EMBODIMENT

Referring initially to FIG. 1, the main supporting framework for a slitting apparatus with which the roller assembly of the present invention is utilized includes a horizontal upper beam 10 and a parallel lower beam 11. The beams 10 and Il extend across the width of the slitting apparatus and are somewhat longer than the maximum width of a continuous moving web 12 of corrugated paperboard which moves between the beams and the attached components of the slitting apparatus to be described hereinafter. A plurality of upper tool heads 13 are attached to the underside of the upper beam 10 for individual movement across the width of the web 12 on a pair of linear ways 14 attached to the beam 10. Each tool head 13 has a pair of linear bearing pads 15 attached to its upper edge, which bearing pads connect the tool head to the linear ways 14 for lateral sliding movement across the web to set the tool head in the position where a longitudinal slit in the web 12 is desired.

Referring also to FIG. 2, a rotary tool holder 16 is attached to each tool head 13. The tool holder 16 includes an inner hub 17 which forms the inner race of a rotary bearing. The outer race 18 of the rotary bearing is secured in an annular boss 20 in the tool head 13. The inner hub 17 of the tool holder has an axial through bore 21 having a non-circular cross section, such as the hexagonal shape shown in FIG. 1. The through bores 22 of the tool holders 16 mounted on a plurality of tool heads 13 lie on a common axis. A driveshaft 22 having a hexagonal cross section is mounted to extend through the bores 21 in each of the plurality of coaxially mounted tool holders 16. The driveshaft 22 extends across the full width of the apparatus and is connected at one end to suitable drive means, whereby its driving rotation causes tool holders 16 to rotate with respect to the tool heads 13. Also, the driveshaft 22 provides support for the commonly mounted tool holders 16 and tool heads 13 for movement along the linear ways 14. Each tool holder 16 includes an outer hub 23 to which a thin annular slitting blade 24 is demountably attached in a manner more fully described in U.S. Pat. No. 5,090,281. Each slitting blade 24 depends downwardly from its respective tool head 13 such that the circular cutting edge extends below the underside 25 of the corrugated paperboard web 12 as the web travels through the slitting station.

As also described in the above identified U.S. patent, the circular slitting blade 24 preferably has a smooth continuous peripheral cutting edge 26 which is defined by a pair of opposite beveled edge faces 27. Each blade may have a thickness, radially inwardly of the edge faces 27, in the range of 0.035 to 0.045 inch (0.9 to 1.1 mm). Because the slitting blades 24 are operated at high speed, which may be three or more times the speed of the moving web 12, a substantial amount of heat is generated and, in addition, the blade edges eventually become dull and must be resharpened. When used to slit corrugated paperboard, particularly as it exits the wet end of a corrugating machine, the typical starch-based adhesive used to secure the multilayer paperboard web tends to stick to and build up on the cutting blade 24. Therefore, the slitting apparatus also preferably includes a sharpening device 28, whereby each blade edge may be sharpened on-the-fly. The sharpening device 28 is attached to the tool head 13 and may be periodically activated to touch each of the opposite blade edge faces 27 as required for sharpening. A lubricating device 30 is also attached to the tool head 13 to apply a thin coating of a lubricant or anti-stick liquid to the opposite faces of the blade to prevent adhesive build up thereon. The lubricating device 30 preferably includes a pair of wick members 31 which are retained in constant light contact with the opposite faces of the blade to distribute the lubricant thereon.

A plurality of roller assemblies 32 of the present invention are provided, one for each slitting blade 24, and are supported for individual sliding movement along a single lower linear way which, in turn, is attached to the upper surface of the lower beam 11. Each roller assembly 32 is supported for movement along the linear way 33 by a bearing pad 34 similar to the bearing pads 15 used to support the upper tool heads 13. Each roller assembly 32 includes a pair of identical rollers 35 positioned to support the moving web 12 by tangent contact with the underside 25 of the web and to receive the lower edge of the slitting blade therebetween as the blade projects below the underside of the web during slitting. Each of the rollers 35 is mounted on a separate rotational axis which axis is defined by a short stub shaft 36. The stub shaft axes are disposed in a common vertical plane, but are angled oppositely downwardly at a very small angle, e.g. 1°, so that the inner adjacent faces 37 of the pairs of rollers 35 define therebetween a downwardly divergent slot 38. With each of the roller supporting shafts 36 positioned at a downwardly sloping angle of 1°, the angle of divergence of the slot is 2°. As a result, the roller faces 37 at the upper portion of the rollers 35 where they make tangent contact with the underside of the web 12 are closer together than the diametrically opposite lower portions of the roller faces 37.

Each roller-supporting stub shaft 36 is attached to a shaft-supporting side plate 40, as best seen in FIG. 3. Each stub shaft 36 may comprise a threaded bolt extending through a suitable tapped hole 41 in the side plate 40. A roller 35 is mounted on each stub shaft 36 by means of an intermediate bearing assembly 42. Each of the rollers 35 preferably comprises a cast aluminum body 43 formed with large open annular recesses 44 on either side of a central web 45. The central web 45 interconnects an outer cylindrical rim 46 and an inner hub 47 with the hub supported for rotation about the stub shaft 36 on the bearing assembly 42. An outer cylindrical sleeve 48 of a harder and more wear resistant material, such as steel, is attached to the outer periphery of the cylindrical rim 46 of each roller 35. The cylindrical sleeve 48 has a width in the axial direction slightly larger than the axial width of the cylindrical rim 46 such that the slot 38 between the adjacent rollers 35 is actually defined by the axially adjacent interior edge faces 50 of the cylindrical sleeves.

The bearing assembly 42 for each roller 35 is separated from the roller side plate 40 by a spring washer assembly 51 which may comprise a series of Belleville washers 52 mounted on the stub shaft 36. The two subassemblies each comprising a roller side plate 40, stub shaft 36 and roller 35 mounted on a bearing assembly 42, are secured together by a pair of side plate bolts 53 extending through spacer sleeves 54. The spring washer assemblies 51 for each roller 35 are selected to be sufficient to cause contact between the adjacent interior edge faces 50 of the cylindrical sleeves 48 on the rollers. However, because the axes of the tapped holes 41 in the roller side plates 40 are angled 1° from perpendicular to the side plates, only the upper edge portions of the roller edge faces 50 are in direct engagement, as shown in FIG. 3. The Belleville washer assemblies 51 are selected to impose an axial load between adjacent roller faces 50 of about seven pounds (3.2 kg). This relatively light loading imposed on the slitting blade 24 which is inserted in the slot 38 between the rollers, as will be described, provides a significant benefit without interfering with operation of the slitting mechanism.

The assembled roller pair is mounted on a support stand 55 between a pair of vertical support plates 56 which are secured together at their lower edges by a base plate 57. Specifically, the roller-supporting side plates 40 are each attached near to the upper end of a support plate 56 with coaxially disposed mounting bolts 58 extending through aligned holes 59 in the side plates 40 and corresponding bolt holes in the upper ends of the support plates. The roller assembly 32 may thus rotate in a vertical plane about the common axis of the bolts 58 with respect to the support stand 55.

The support stand 55 is mounted on the lower bearing pad 34 which, in turn, is slidably mounted on a lower linear way 33. The linear way 33 is mounted on an intermediate cross beam 62 which, in turn, is mounted on the lower main beam 11. Rotational movement of the roller assembly 32 in the support stand is controlled by suitable biasing means and stop means which allow limited rotational movement of the assembly with respect to the upper slitting blade 24 between an upper position in which there is maximum receipt of the blade cutting edge 26 and edge faces 27 in the slot 38 between the rollers 35, and a lower position in which the cutting blade edge 26 is fully disengaged from the slot 38. The upper roller position is shown in solid lines in FIG. 4 and the lower roller position is shown in phantom lines in that figure. An intermediate operating position in which the cutting blade edge is just received in the slot 38 between the rollers 35 is shown in FIG. 1.

A pair of tension springs 63 are attached between the support stand base plate 57 and the upper end of each roller side plate 40 to bias the roller assembly upwardly toward its position of maximum blade edge receipt in the slot 38. The upper end of each tension spring 63 is attached to a side plate bolt 53 and the lower end of each spring is attached to an eye bolt 64 mounted for vertical adjustable movement in the base plate 57. An up-stop bracket 65 is attached to each support plate 56 of the support stand 55 and extends upwardly at an angle from the center of the support plate 56 along side each roller side plate 40. A stop pin 66 is attached to the upper end of the up-stop bracket 65 in a position where it is engaged by the upper edge of the side plate 40 as it rotates upwardly under the bias of tension spring 63. Engagement of the stop pins 66 by the roller side plates 40 defines the maximum upward position of the rollers 35 and the position of maximum receipt of the cutting blade edge in the slot 38.

As the corrugated paperboard web 12 moves into the nip created by the slitting blade 24 rotating in the slot 38 between the rollers, as shown in FIG. I, the weight of the web will cause the roller assembly to rotate downwardly against the bias of the tension springs 63 to the cutting position shown therein. To prevent further downward movement of the roller assembly beyond the slitting position shown in FIG. 1, the lower ends of the roller side plates 40 engage a horizontal cross bar 70 of a U-shaped down-stop bracket 68 which is pivotally attached by its legs 71 to the lower ends of the vertical support plates 56 of the support stand 55. The down-stop bracket 68 is held in its operative position shown in FIG. 1 by a pair of removable locking pins 72, each extending through aligned holes in one vertical support plate 56 and the adjacent leg 71 of the down-stop bracket. When the locking pins 72 are removed, the down-stop bracket 68 may be rotated about its lower pivotal mounting 73 to the phantom line position shown in FIG. 4. In this position, the roller assembly may be biased downwardly against the force of the tension springs 63 to cause the rollers to be completely disengaged from the cutting blade edge 26.

As indicated previously, in a typical slitting apparatus, a plurality of upper tool heads 13 and slitting blades 24 are mounted on a common driveshaft 22 for individual movement and selective positioning along the linear ways 14 to provide a plurality of longitudinal slits in the advancing web 12 at selected positions across the width of the web. Referring particularly to FIG. 1, to individually position each upper tool head 13, an electric servo motor 74 is mounted on each tool head and drives a pinion gear 75 positioned to engage a linear toothed rack 76 attached to the underside of the upper beam 10, in a manner well known in the art and as shown, for example, in U.S. Pat. No. 4,627,214. In accordance with the preferred embodiment of the present invention, movement of each upper tool head 13 and associated slitting blade 24 causes simultaneous sliding movement of the lower roller assembly 32 along the lower linear way 33 as a result of the overlapping contact of the blade cutting edge in the slot 38 between the rollers 35. Thus, positioning movement of each slitting blade 24 causes automatic positioning of the associated roller assembly 32. As also known in the prior art, each of the plurality of upper tool heads 13 may be simultaneously locked in their selected slitting positions with a common lockdown apparatus which may include a long cylindrical locking cam 77 which extends across the full width of the apparatus and supported for rotation on its axis between a locking position with its cylindrical outer surface in locking engagement with a locking pad 78 on each tool head and an unlocked position in which an axial flat surface 80 on the cam 77 is positioned directly adjacent and spaced from the locking pad 78. In the latter position, the tool heads are unlocked for repositioning movement in response to operation of their respective motors 74. The lower roller assemblies 32, which are carried along the lower linear way 33 with movement of the respective tool heads 13, need not be separately locked in the selected operating position.

Rather, they remain in operating position as a result of receipt of the slitting blade in the slot 38.

As previously indicated and referring once again to FIG. 4, under the normal bias of tension springs 63, the roller assembly 32 is pivoted upwardly against the stop pins 66 to the position of maximum blade edge receipt in the slot 38. In this position, the upper tool heads 13 may be moved along the upper linear ways 14 and carry the roller assembly therewith along the lower linear way 33 with minimal threat of breaking or damaging the thin slitting blade 24. When the incoming corrugated paperboard web 12 (which is preferably supported just upstream of the roller assemblies 32 by an appropriate web supporting surface 81) contacts the roller assemblies, the weight of the board will cause the roller assemblies 32 to pivot downwardly to the normal slitting position. The normal slitting position is defined by the position in which the roller supporting side plates 40 engage the down stop bracket 68 and the slitting blade cutting edge 26 is just received within the slot 38 between the rollers 35. The eye bolts 64 to which the ends of the tension spring 63 are attached may be adjusted to selectively vary the downward force necessary to cause the roller assemblies to pivot to the desired operating position. A force of approximately four pounds (1.8 kg), for example, has been found to be suitable.

As previously indicated, the slight angular mounting of the roller stub shafts 36 in the supporting side plates 40 results in a downwardly divergent slot 38 as defined by the interior edge faces 50 of the cylindrical roller sleeves 48. The tapped holes 41 in the roller side plates 40 are positioned such that the axes of the stub shafts and rollers mounted thereon are in a substantially vertical plane when the roller assembly is disposed in its operating position shown in FIG. 1. As also previously indicated, the Belleville washer assemblies 51 bias portions of the roller edge faces 50 into contact and, when the slitting blade is received in the slot 38, the portions of the edges faces 50 contact the adjacent edge faces 27 of the slitting blade, as may best be seen in FIG. 2. The contact between the upper portions of the roller edge faces 50 and the slitting blade 24 occurs at the point where the web is slit. Two-fold benefits result from this contact. First of all, the light contact provides a scraping effect which helps prevent a build up of starch or adhesive on the blade edge faces 27. Also, the small paperboard scraps and slivers which are inevitably created in the slitting operation, do not enter the slot as easily and, when scrap does enter the slot, the downwardly divergent shape thereof allows the scrap to be easily ejected, enhanced by the rotation of the rollers 35.

Eventually, abrasion from the paperboard being slit will result in wear of the interior edge faces 50, even where the cylindrical sleeves 48 are made of a harder steel material. When edge wear reduces the edge faces 50 to a point where the cylindrical rims 46 of the roller body 43 approaches contact with the slitting blade, each of the rollers 35 may be reversed on its respective stub shaft 36 to present a new set of interior edge faces 50 defining the slot 38. Preferably, the annular recesses 44 in the roller bodies 43 are filled with lightweight ring-shaped plastic inserts 82 held in position by suitable mounting screws 83. The plastic inserts 82 create a substantially smooth, flat face between adjacent rollers, thereby eliminating crevices in which scrap and adhesive may accumulate and enhancing discharge of scrap from the downwardly divergent slot 38. The plastic inserts may be remounted in the opposite recesses 44 when the rollers are reversed.

When it becomes necessary to remove a slitting blade 24 from the tool holder 16, as for replacement, the roller assembly 32 is rotated downwardly out of engagement with the slitting blade. To accomplish this, the locking pins 72 are pulled from the legs 71 of the down stop bracket 68 and the latter is pivoted downwardly to the phantom position shown in FIG. 4. The roller assembly may then be manually pivoted downwardly against the bias of the tension springs 38 to clear the blade edge and then slid along the lower linear way 33 until the slitting blade 24 is removed and replaced with a new one.

The slight angle (e.g. 1° from the horizontal) at which the axes of each roller 35 is mounted results in a similar slight angular positioning of the outer surfaces of the cylindrical roller sleeves 48 which make tangent contact with the underside 25 of the web 12. However, the angle of mounting is so slight that substantially full surface contact between the outer roller surfaces and the flexible paperboard web is maintained.

Various modes of carrying out the present invention are contemplated as being within the scope of the following claims particularly pointing out and distinctly claiming the subject matter which is regarded as the invention.

I claim:

1. A roller assembly for an apparatus for slitting a running web of paperboard, said apparatus including a thin annular rotary cutting blade positioned with its axis of rotation over the web and having a peripheral cutting edge defined by opposite blade faces extending downwardly through the path of the web to slit the web in the direction of web travel, said roller assembly positioned to support the web at the point of the slit and including a slot positioned to receive the blade edge therein, said roller assembly further comprising:

a pair of rollers rotatably mounted to provide tangent contact with the underside of the web and to define therebetween said slot;

said rollers mounted on separate rotational axes to present adjacent roller faces which define therebetween a downwardly divergent slot; and, means for biasing said rollers toward one another to cause the axially adjacent radial edge portions of the rollers at the point of web contact to bear against the blade faces.

2. The roller assembly as set forth in claim 1 wherein the axes of said rollers are disposed in a common substantially vertical plane and intersect one another at an angle equal to the angle of divergence of the slot.

3. The roller assembly as set forth in claim 1 further comprising:

a pair of side plates for supporting said rollers, each of said side plates positioned adjacent an opposite outer face of one of said rollers;

a stub shaft for each roller defining the rotational axis thereof and attached to one of said side plates and supporting said roller for rotation thereon; and, said biasing means disposed between at least one of said side plates and the roller attached thereto.

4. The roller assembly as set forth in claim 3 wherein said biasing means comprises a spring washer assembly mounted on each stub shaft between said side plate and the adjacent roller face.

5. The roller assembly as set forth in claim 1 including means for mounting said roller assembly for movement relative to the cutting blade to vary the amount of the blade edge received in said slot.

6. The roller assembly as set forth in claim 5 wherein said mounting means includes means for biasing said roller assembly to a position of maximum blade edge receipt in said slot, and upper stop means for limiting the amount of maximum receipt of said blade edge.

7. The roller assembly as set forth in claim 6 including adjustable lower stop means positioned in the path of movement of said roller assembly in opposition to said biasing means for biasing said roller assembly, said lower stop means having a first position for preventing disengagement of the blade edge from said slot and a second position for permitting said disengagement.

8. The apparatus as set forth in claim 1 comprising:

an upper tool head mounting the rotary cutting blade and movable laterally across the width of the web on a line parallel thereto;

a lower tool head mounting said roller assembly and movable laterally across the width of the web on a line parallel to the line of movement of said upper tool head; and, means for driving one of said upper and lower tool heads across the web.

9. The apparatus as set forth in claim 8 wherein said driving means is operative to drive said upper tool head and to carry said lower tool head therewith.

* * * * *